US005622257A

United States Patent [19]

Deschenes et al.

[11] Patent Number: 5,622,257

[45] **Date of Patent: *Apr. 22, 1997**

[54] FASTENER FOR ATTACHING A BUTTON TO A GARMENT OR LIKE MATERIAL AND FASTENER CLIP INCLUDING ONE OR MORE OF SAID FASTENERS

[75] Inventors: Charles L. Deschenes, North Attleboro; Terence J. Jones, Bolton, both of Mass.; William J. Cooper, Woonsocket, R.I.

[73] Assignee: Avery Dennison Corporation, Pasadena, Calif.

[ * ] Notice: The term of this patent shall not extend beyond the expiration date of Pat. No. 5,383,260.

[21] Appl. No.: 309,010

[22] Filed: Sep. 19, 1994

Related U.S. Application Data

[63] Continuation-in-part of Ser. No. 989,201, Dec. 11, 1992, Pat. No. 5,383,260.

[51] Int. Cl.[6] ..... B65D 85/24

[52] U.S. Cl. ..... 206/345; 206/343; 206/338; 24/711; 24/90.1; 24/710.5

[58] Field of Search ..... 206/338, 343, 206/345; 24/90.1, 94, 95, 710.5, 710.8, 710.9, 711

[56] References Cited

U.S. PATENT DOCUMENTS

| | | | |
|---|---|---|---|
| 648,071 | 4/1900 | Griffith et al. | 24/94 |
| 1,378,108 | 5/1921 | Hart et al. | 24/94 |
| 2,451,487 | 10/1948 | Haelster | 24/94 |
| 2,935,434 | 5/1960 | Dawson . | |
| 3,399,432 | 9/1968 | Merser . | |
| 3,494,004 | 2/1970 | Bone . | |
| 3,518,729 | 7/1970 | Merser . | |
| 3,815,798 | 6/1974 | Lavitch et al. . | |
| 3,893,612 | 7/1975 | Bone . | |
| 3,900,925 | 8/1975 | La Torraca . | |
| 4,229,930 | 10/1980 | Ostermaier . | |
| 4,281,782 | 8/1981 | Marsh et al. . | |
| 4,296,698 | 10/1981 | Davidson et al. . | |
| 4,316,562 | 2/1982 | Davidson et al. . | |
| 4,361,101 | 11/1982 | Marsh et al. . | |
| 4,456,123 | 6/1984 | Russell . | |
| 4,533,076 | 8/1985 | Bourque . | |
| 4,877,172 | 10/1989 | Franklin et al. . | |
| 4,901,854 | 2/1990 | Bone et al. | 206/345 |
| 5,224,597 | 7/1993 | Hauchard | 206/345 |
| 5,383,260 | 1/1995 | Deschenes et al. . | |

FOREIGN PATENT DOCUMENTS

| | | | |
|---|---|---|---|
| 572187 | 9/1945 | United Kingdom | 24/711 |

*Primary Examiner*—David T. Fidei
*Attorney, Agent, or Firm*—Kriegsman & Kriegsman

[57] ABSTRACT

A fastener for use in attaching a button to a garment or a piece of fabric and a fastener clip including one or more of said fasteners. In a preferred embodiment, the fastener comprises a U-shaped flexible filament and a pair of transverse feet, the transverse feet being disposed at opposite ends of the U-shaped flexible filament. The U-shaped flexible filament is generally rectangular in cross-section. The width of the filament is substantially uniform over its length whereas the thickness of the filament is greatest in its arcuate region (to maximize the strength of the fastener) and least towards the feet. Because of its U-shape, the filament is permitted to extend between adjacent button holes, thereby creating the appearance of thread. The transverse feet, which extend parallel to one another and perpendicularly to the plane of the filament, are sized and shaped both to fit through a button hole and, once inserted through the button hole and an underlying garment, to securely engage the underside of the garment. To minimize contact with a person's skin, the feet of the present fastener are preferably shorter than the transverse bars of existing button fasteners and are preferably comparable in overall size to a knot of thread used to secure a button to a sheet of clothing material. In addition, the feet preferably have rounded ends, a flat top surface, and a contoured bottom surface to minimize contact with, and hence irritation of, a person's skin.

10 Claims, 18 Drawing Sheets

FASTENER FOR ATTACHING A BUTTON TO A GARMENT OR LIKE MATERIAL AND FASTENER CLIP INCLUDING ONE OR MORE OF SAID FASTENERS

CROSS-REFERENCE TO RELATED APPLICATIONS

The present application is a continuation-in-part of U.S. patent application Ser. No. 07/989,201, filed Dec. 11, 1992, now U.S. Pat. No. 5,383,260.

BACKGROUND OF THE INVENTION

The present invention relates to a new and novel fastener which is particularly well-suited for use in coupling or recoupling a button or the like to a garment or similar material and also relates to a new and novel fastener clip which includes one or more of said fasteners.

The conventional method of attaching buttons to garments or fabrics, either by machine or by hand, is with thread. The button is held in place and a needle containing thread is inserted through each of two, three or more holes in the button and into the material several times until sufficient strands of thread exist to securely hold the button to the material. The thread must then be tied or otherwise fastened so that it will not unravel. In some instances, where it is desired to elevate the button from the material, a pedestal effect is achieved by laterally wrapping the strands with additional thread. The disadvantages to this method of securing buttons to fabric or garments are several. First of all, it is a slow and tedious job and the button can soon become detached if only one of the threads is severed or if the ends of the thread are not secured properly.

In the commonly assigned U.S. Pat. Nos. 3,399,432, 3,470,834, and 3,494,004, all of which are incorporated herein by reference, there is described a plastic fastener which may be used instead of thread to attach a button to an article of clothing. The fastener typically comprises a flexible filament having a head at one end and a transverse bar at the opposite end. A plurality of such fasteners are typically manufactured as part of a clip in which the fasteners are interconnected in a row to a stringer or runner bar connected to the transverse bars of the fasteners by corresponding necks or connector posts. To sever an individual fastener from the fastener clip and to attach the severed fastener to a desired article (e.g., through a button hole and into an article of clothing), a fastener attaching device is typically used. Such a device typically comprises a casing, a needle projecting from the casing, the needle and the casing having longitudinal bores in alignment with each other, a plunger slidable back and forth within said bores, a handle telescoping over the rear of the casing for sliding said plunger within said bores, and means for feeding fasteners into the device successively with the transverse bars in alignment with said bores ahead of the plunger so that they may be projected through the needle by reciprocating the plunger. Typically, the rear end of the needle is shaped to define a knife edge so that insertion of the transverse bar into the longitudinal bore of the needle using the plunger causes the knife edge of the needle to sever the connector post connecting the fastener to the remainder of the fastener clip.

While the above-described fasteners have been found to be generally satisfactory for attaching buttons to certain articles of clothing, they have not found universal application for the following reasons: First, when placed in direct contact with a person's skin, the transverse bar of the fastener has a tendency to be irritating. This is in part because the above-described severing of the connector post often leaves a burr on the bottom of the transverse bar and is in part because of the somewhat sharp ends and large size of the transverse bar. Second, the fasteners are often too big to be used with many buttons and, therefore, require the use of specially designed buttons having large holes. Third, the fasteners tend to be conspicuous in appearance due to the fact that a separate fastener is used for every button hole, as opposed to being looped between two or more button holes in the same way that thread typically is.

SUMMARY OF THE INVENTION

It is an object of the present invention to provide a new and novel fastener which is particularly well-suited for attaching a button or the like to a garment or similar material.

It is another object of the present invention to provide a fastener as described above that is less irritating than existing like fasteners when used in such a way that it is placed in direct contact with a person's skin, e.g., when used to attach a button to a an article of clothing.

It is still another object of the present invention to provide a fastener as described above that is appropriately sized for use with conventional buttons.

It is still yet another object of the present invention to provide a fastener as described above which, when used to attach a button to a garment or the like, is inconspicuous in appearance, i.e., can achieve a look similar to that achieved using thread.

It is a further object of the present invention to provide a fastener as described above that is designed for maximum strength while still permitting installation through very small holes such as are found in fine garments.

It is still a further object of the present invention to provide a new and novel fastener clip which includes one or more of the fasteners described above.

It is still yet a further object of the present invention to provide a fastener clip as described above which can be mass produced and which is capable of including a plurality of the fasteners described above.

Additional objects, features, and advantages of the present invention will be set forth in part in the description which follows, and in part will be obvious from the description or may be learned by practice of the invention. The objects, features and advantages of the invention may be realized and attained by means of the instrumentalities and combinations particularly pointed out in the appended claims.

In a preferred embodiment of the invention, the fastener comprises a U-shaped flexible filament and a pair of transverse feet, the transverse feet being disposed at opposite ends of the U-shaped flexible filament. The U-shaped flexible filament is generally rectangular in cross-section. The width of the filament is substantially uniform over its length whereas the thickness of the filament is greatest in its arcuate region (to maximize the strength of the fastener) and least towards the feet. Because of its U-shape, the filament is permitted to extend between adjacent button holes, thereby creating the appearance of thread.

The transverse feet, which extend parallel to one another and perpendicularly to the plane of the filament, are sized and shaped both to fit through a button hole and, once inserted through the button hole and an underlying garment, to securely engage the underside of the garment. To minimize contact with a person's skin, the feet of the present fastener are preferably shorter than the transverse bars of existing button fasteners and are preferably comparable in overall size to a knot of thread used to secure a button to a sheet of clothing material. In addition, the feet preferably have rounded ends, a flat top surface, and a contoured bottom surface to minimize contact with, and hence irritation of, a person's skin.

Preferably, two fasteners of the type described above are incorporated into a unitary structure of molded plastic hereinafter referred to as a fastener clip, the fastener clip additionally comprising a pair of parallel runner bars. Each fastener is connected to the pair of runner bars by a pair of severable connector posts, each connector post extending between the side of one of the feet and a corresponding runner bar so that, when the connector post is severed, a burr is not left on the underside of the feet where it may irritate a person's skin, but rather, is left on the side of the feet where it will not be in contact with a person's skin. The outer edges of the runner bars are preferably provided with indentations which, as will be discussed below, are used to properly feed the fastener clip into a fastener attaching tool. One of the runner bars extends further downwardly than the other to facilitate insertion of the fastener clip into the fastener attaching tool.

The present invention is also directed to a method of making the above-described fastener clip so that knit-lines, i.e., regions of structural weakness caused, during molding, by the convergence of two intersecting wavefronts of molten plastic, do not form within the fasteners of the fastener clip.

The present invention is further directed to a method of using the above-described fastener clip, in combination with a fastener attaching tool, to dispense fasteners useful in the attachment of buttons to a garment or similar material.

BRIEF DESCRIPTION OF THE DRAWINGS

The accompanying drawings, which are hereby incorporated in and constitute a part of this specification, illustrate the preferred embodiments of the invention and, together with the description, serve to explain the principles of the invention. In the drawings, wherein like reference numerals represent like parts.

DETAILED DESCRIPTION OF PREFERRED EMBODIMENTS

Figure 1:
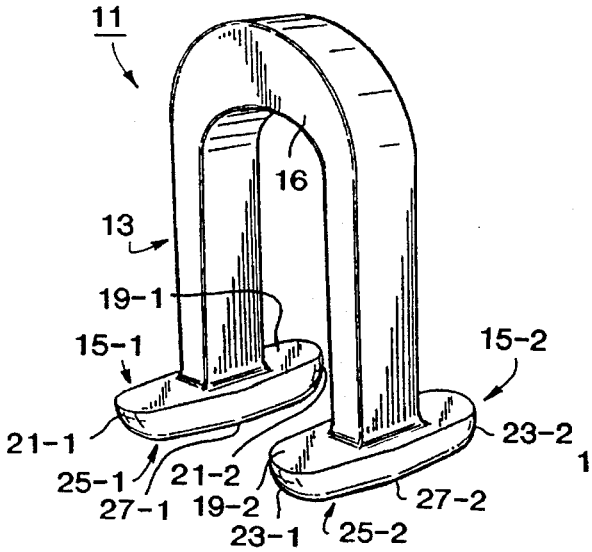
FIG. 1 is an enlarged front perspective view of one embodiment of a fastener constructed according to the teachings of the present invention for attaching a button to a garment or like material.
Figure 2:
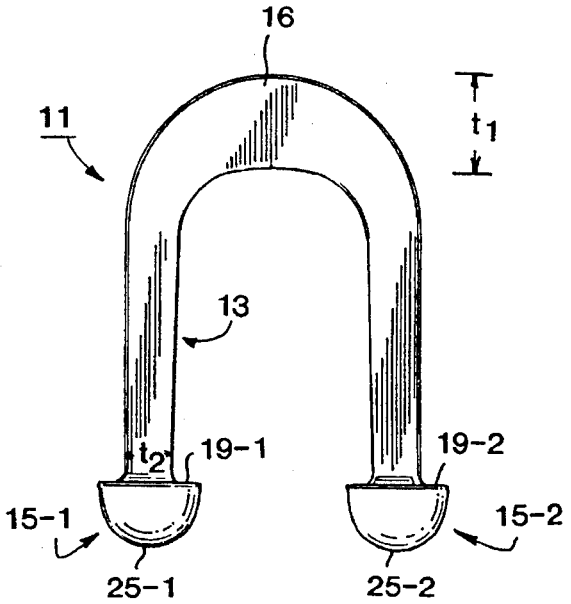
FIG. 2 is a front view of the fastener shown in FIG. 1, the rear view being a mirror image thereof.
Figure 3:
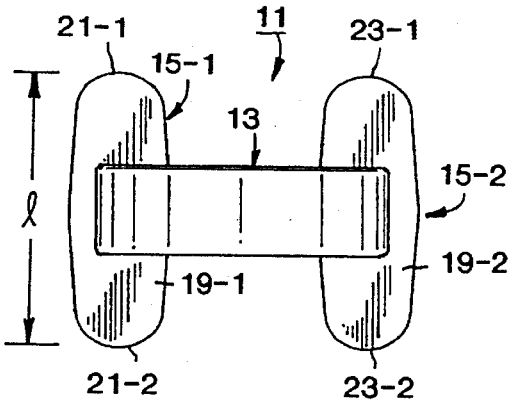
FIG. 3 is a top view of the fastener shown in FIG. 1.
Figure 5:
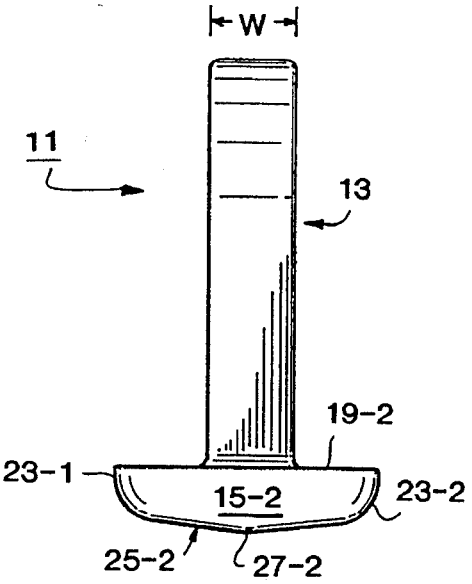
FIG. 5 is a right side view of the fastener shown in FIG. 1, the left side being a mirror image thereof.
Figure 4:
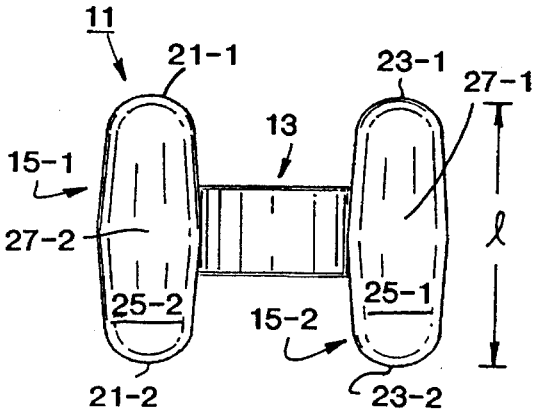
FIG. 4 is a bottom view of the fastener shown in FIG. 1.
Figure 6:
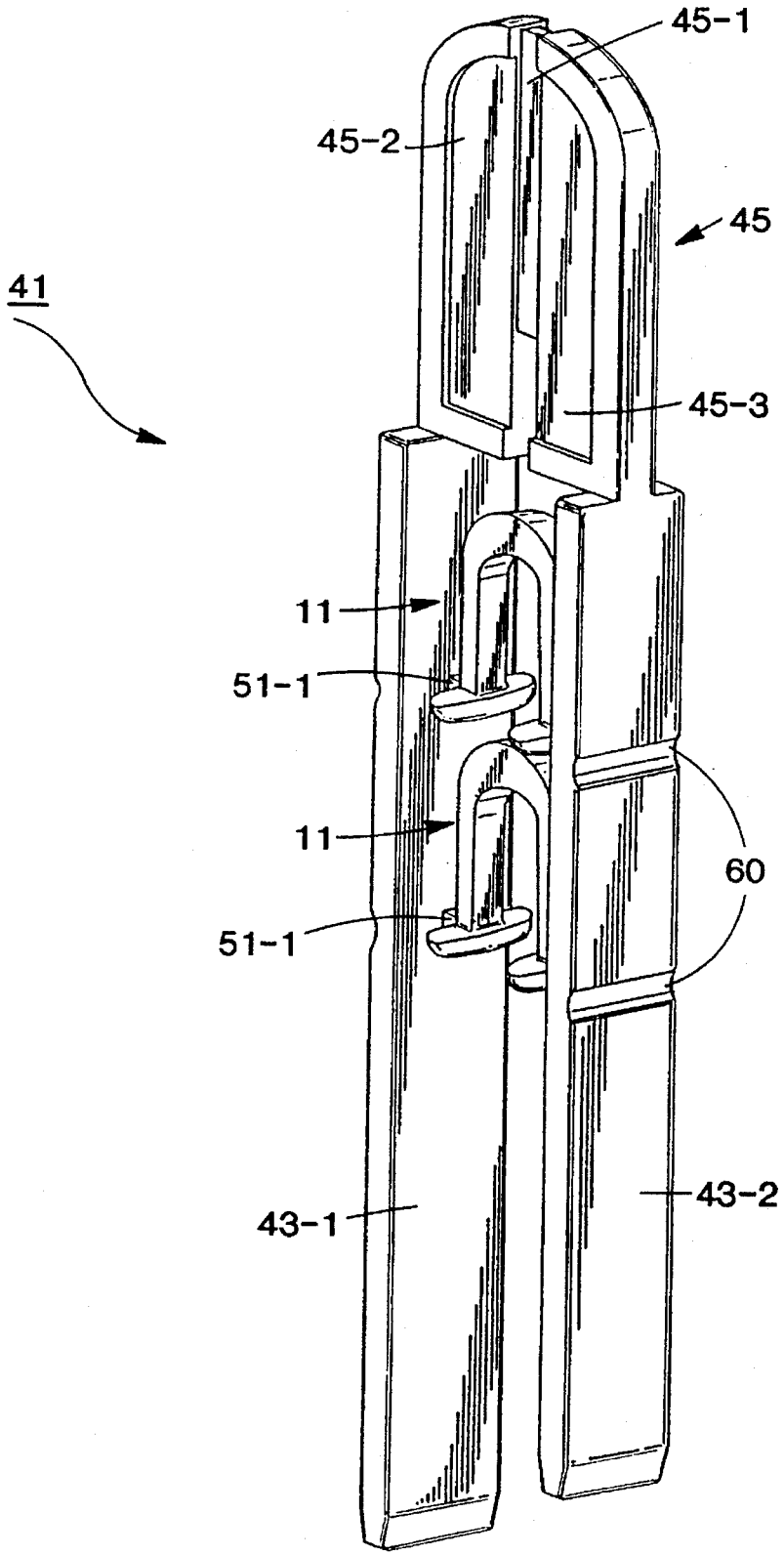
FIG. 6 is an enlarged front perspective view of one embodiment of a fastener clip constructed according to the teachings of the present invention.
Figure 7:
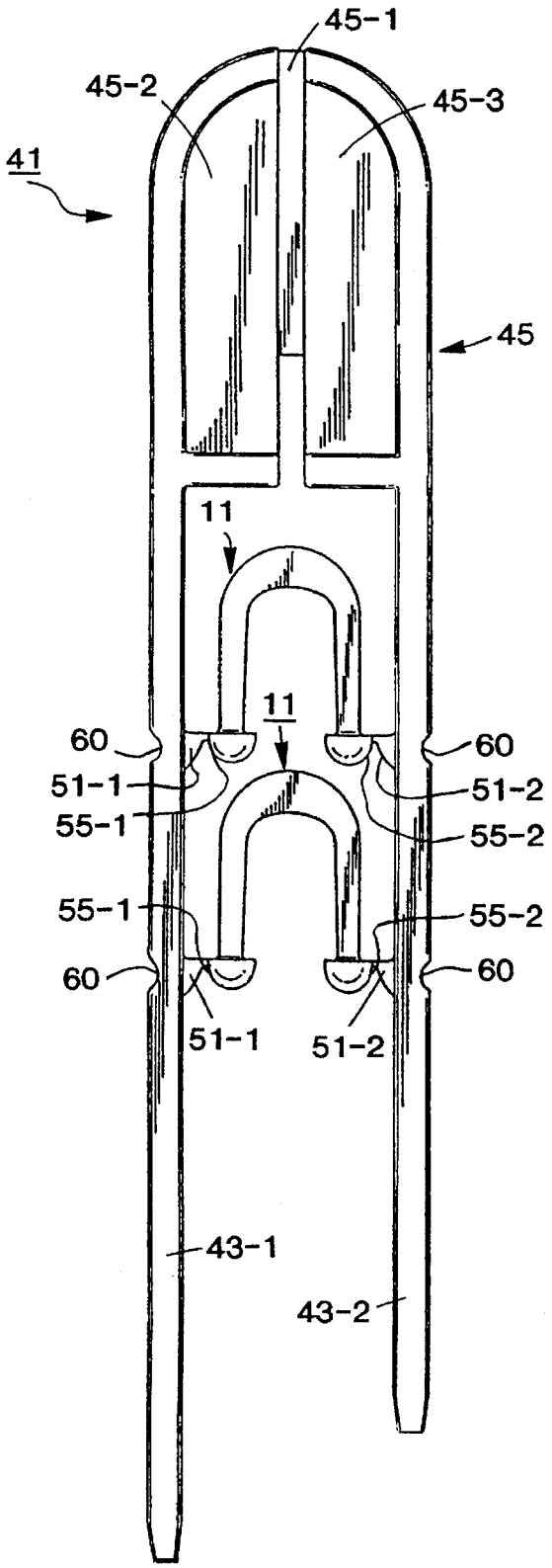
FIG. 7 is a front view of the fastener clip shown in FIG. 6.
Figure 8:
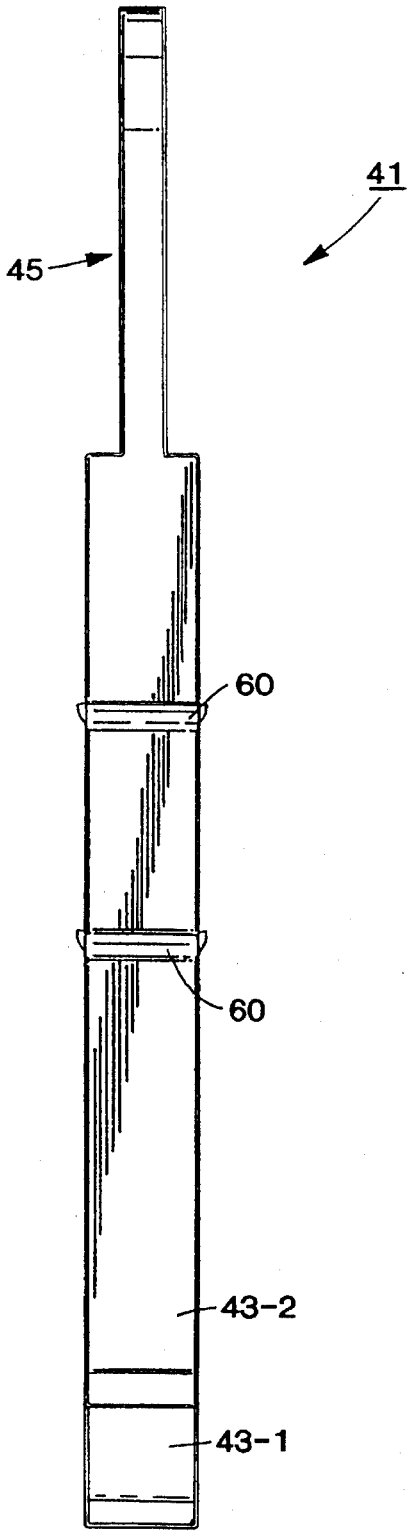
FIG. 8 is a right side view of the fastener clip shown in FIG. 6.
Figure 9:
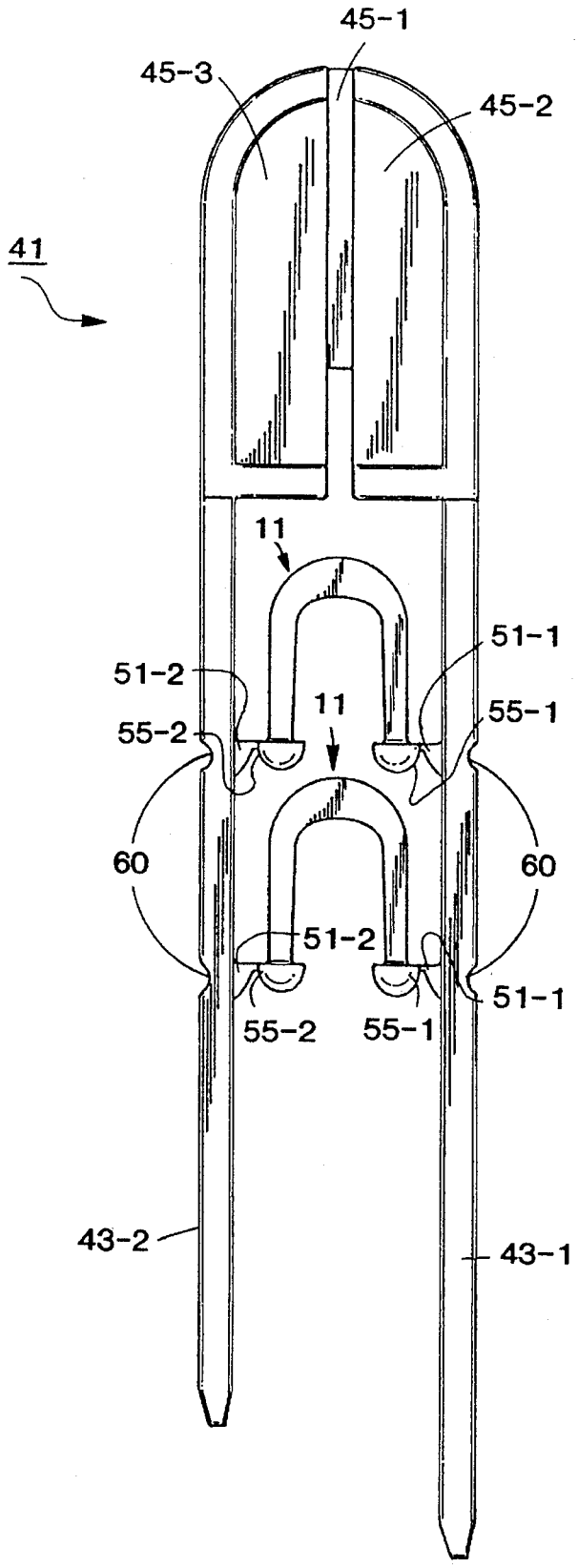
FIG. 9 is a rear view of the fastener clip shown in FIG. 6.
Figure 10:
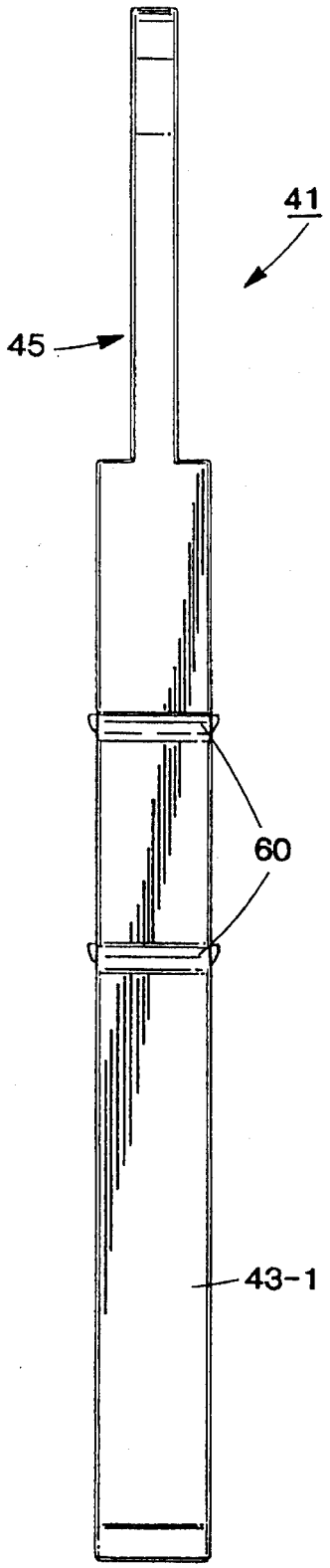
FIG. 10 is a left side view of the fastener clip shown in FIG. 6.
Figure 11:
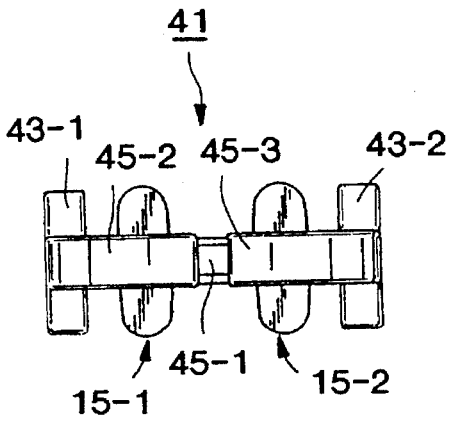
FIG. 11 is a top view of the fastener clip shown in FIG. 6.
Figure 12:
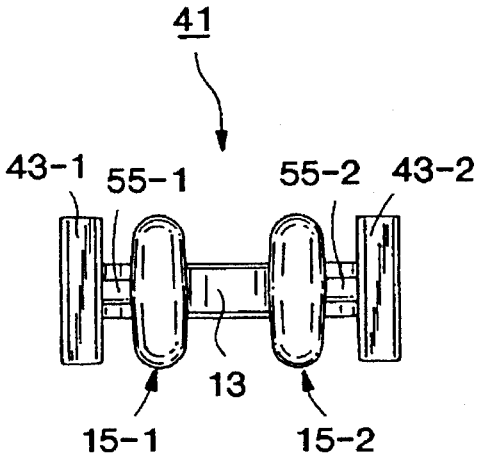
FIG. 12 is a bottom view of the fastener clip shown in FIG. 6.

Referring to FIGS. 1 through 5, there are shown various views of a fastener constructed according to the teachings of the present invention for attaching a button to a garment or like material, the fastener being represented generally by reference numeral 11.

Fastener 11 includes a flexible U-shaped filament 13 and a pair of transverse bars or feet 15-1 and 15-2 disposed at opposite ends thereof. In order to maximize the strength of fastener 11, U-shaped flexible filament 13 is generally rectangular in cross-section, filament 13 having a width w that is substantially uniform over its length and having a non-uniform thickness, i.e., arcuate region 16 has a thickness $t_1$ greater than the thickness $t_2$ near feet 15-1 and 15-2.

Feet 15-1 and 15-2, which extend parallel to one another and perpendicularly to the plane of filament 13, are appropriately dimensioned so that they may be inserted into a desired garment through a pair of button holes of conventional size and thereafter be retained by the underside of the garment. In order that fastener 11 may be used with garments in which feet 15-1 and 15-2 are placed in direct contact with a person's skin, feet 15-1 and 15-2 include the following features which are designed to minimize contact with and irritation of a person's skin. First, feet 15-1 and 15-2 have a length/which is comparatively small, i.e., approximately 2 mm as compared to 6 mm for the transverse bars of existing like fasteners, and an overall size which is comparable to that of a knot of thread. Consequently, feet 15-1 and 15-2 have relatively little surface area which may come into contact with a person's skin. Second, the top surfaces 19-1 and 19-2 of feet 15-1 and 15-2, respectively, are generally flat. This gives feet 15-1 and 15-2 a low profile and inhibits the rotational movement of feet 15-1 and 15-2 relative to the underside of a garment to which fastener 11 has been attached (see FIG. 26). Third, feet 15-1 and 152 have rounded ends 21-1/21-2 and 23-1/23-2, respectively, as compared to the straight, square ends of conventional transverse bars. Fourth, the bottom surfaces 25-1 and 25-2, respectively, of feet 15-1 and 15-2 are contoured for minimal irritation of a person's skin by extending downwardly furthest and having the greatest cross-sectional diameter at their respective midpoints 27-1 and 27-2 and by sloping upwardly and diminishing in cross-sectional diameter on opposite sides of midpoints 27-1 and 27-2.

Preferably, one or more fasteners 11 are fabricated as part of a fastener clip.

Referring now to FIGS. 6 through 12, there are shown various views of one embodiment of a fastener clip constructed according to the teachings of the present invention, the fastener clip being represented generally by reference numeral 41.

Clip 41 is a unitary structure preferably molded from a translucent or transparent polyurethane or similar material. Clip 41 comprises two identical fasteners 11 for use in attaching a button having four holes; however, it should be apparent that the number of fasteners need not be two and could be any number, depending upon the specific application to which fasteners 11 are to be put. Clip 41 also comprises a pair of runner bars 43-1 and 43-2. Runner bar 43-1 is longer than runner bar 43-2 so that, when inserting fastener clip into the appropriate opening in a fastener attaching tool (see FIGS. 24(*a*) and 24(*b*)), one need not align both runner bars simultaneously with the opening, but rather, need only align runner bar 43-1 with the opening, and then, once runner bar 43-1 has been inserted into the opening, insert runner bar 43-2 thereinto. The different lengths of runner bars 43-1 and 43-2 also make it easier for a user to grasp and to pull fastener clip 41 through a fastener attaching tool after fastener clip 41 has been loaded thereinto.

Figure 13A:
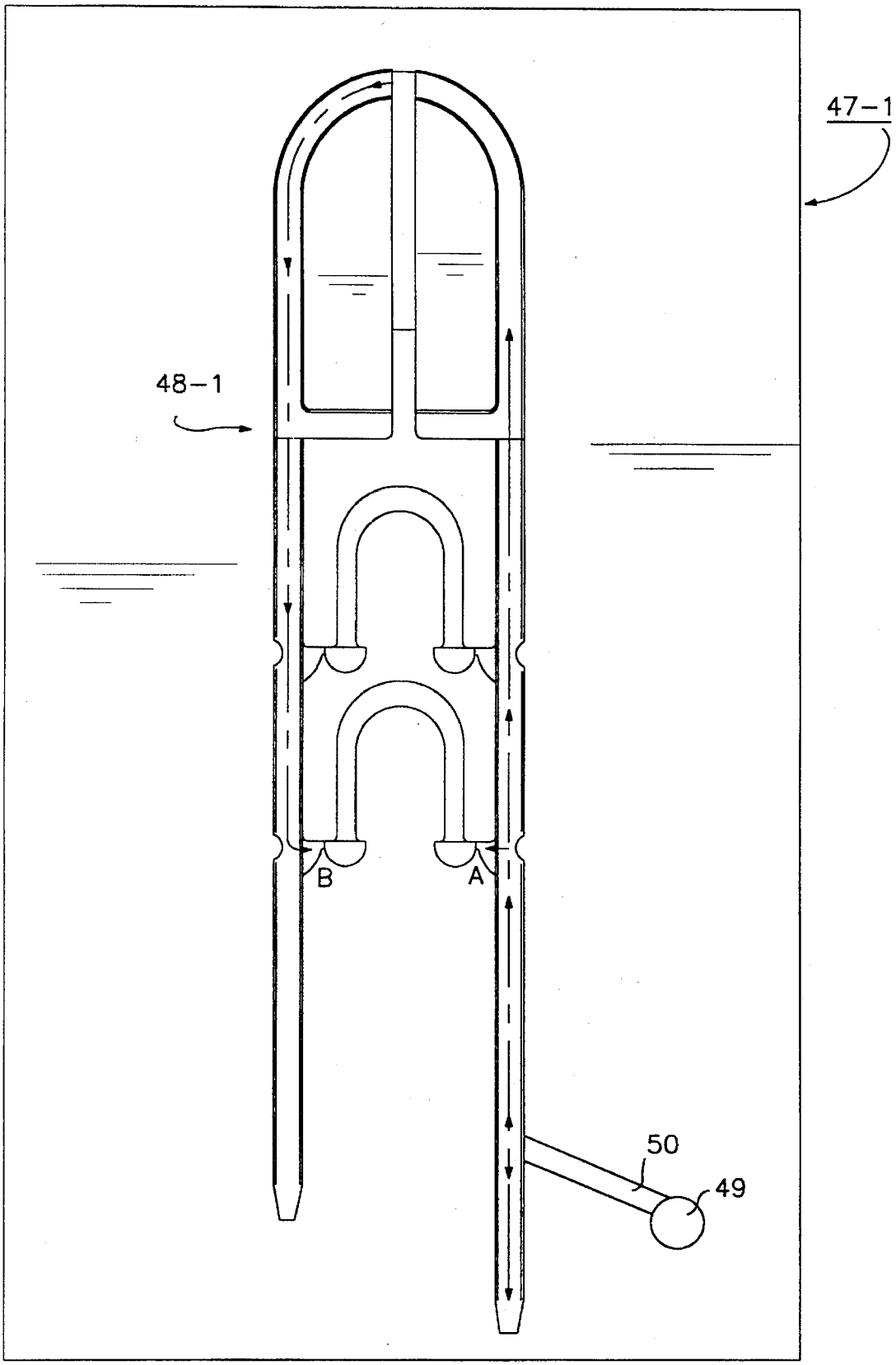
FIGS. 13(*a*) and 13(*b*) are plan views of a pair of cooperating mold plates which are used in the molding of the fastener clip of FIG. 6.
Figure 13B:
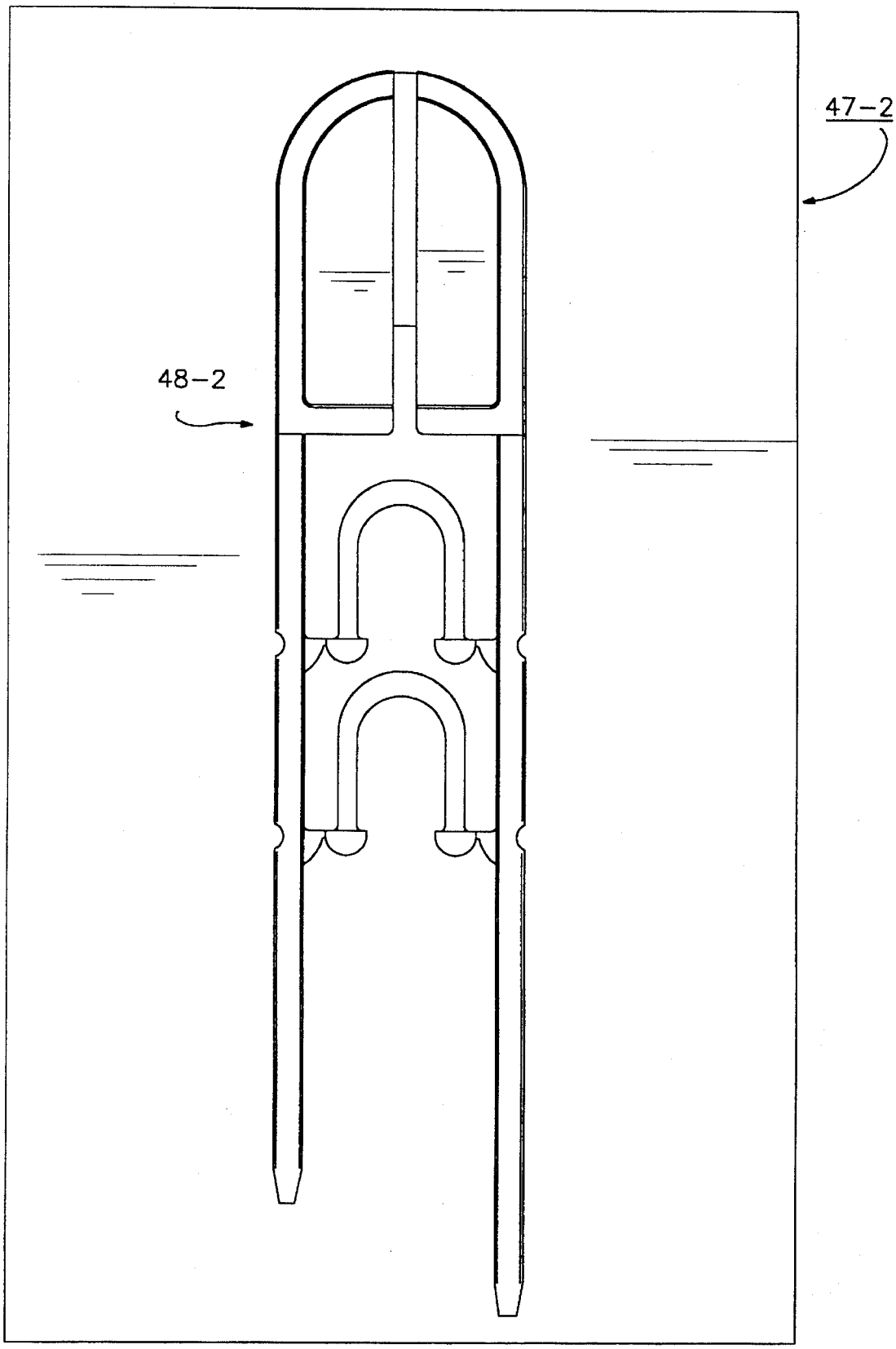

The top ends of runner bars 43-1 and 43-2 are joined together to form a handle 45, which may be grasped by the user in loading fastener clip 41 into a fastener attaching tool. As seen best in FIGS. 6 and 11, handle 45 has a non-uniform thickness, the midportion 45-1 of handle 45 being thinner than the left portion 45-2 and the right portion 45-3 of handle 45. The reason for making midportion 45-1 thinner than left and right portions 45-2 and 45-3, respectively, is to avoid the formation of knit-lines within fasteners 11. Knit-lines are regions of structural weakness caused, during molding, by the convergence of two intersecting wavefronts of molten plastic. As can readily be appreciated, the formation of knit-lines in fasteners 11 is highly undesirable. Referring to FIGS. 13(*a*) and 13(*b*), there can be seen a pair of cooperating mold plates 47-1 and 47-2, respectively, used in the molding of fastener clip 41. Mold plate 47-1 is shaped to include a cavity 48-1 defining the top half of fastener clip 41, and mold plate 47-2 is shaped to include a cavity 48-2 defining the bottom half of fastener clip 41. A transverse opening 49 and a channel 50 are formed in plate 47-1 for conducting molten plastic or the like to cavities 48-1 and 48-2 once plates 47-1 and 47-2 have been fastened together by means not shown. As can be appreciated, if cavities 48-1 and 48-2 were shaped to define a handle 45 of uniform thickness, a knit-line would likely form somewhere within fasteners 11 as the molten plastic would rapidly approach the fastener regions from both of the directions indicated by arrows A and B. However, because cavities 48-1 and 48-2 are constricted in the area of midportion 45-1, thereby inhibiting the flow of liquid therethrough, the flow of molten plastic through fasteners 11 is unidirectional, i.e., solely in the direction indicated by arrow A. This avoids the formation of a knit-line within fastener 11.

Figure 14:
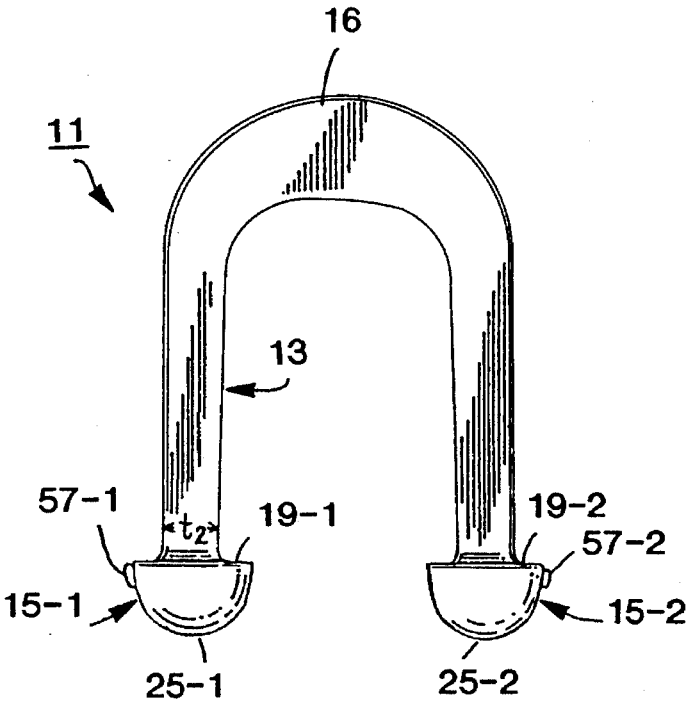
FIG. 14 is an enlarged front perspective view of one of the fasteners shown in FIG. 6 after it has been separated from the remainder of the fastener clip.

Referring back to FIGS. 6 through 12, each fastener 11 can be seen to be connected to runner bars 43-1 and 43-2 by severable connector posts 51-1 and 51-2, respectively, which extend from the outer sides 55-1 and 55-2 of feet 15-1 and 15-2, respectively, to runner bars 43-1 and 43-2. In this manner, when posts 51-1 and 51-2 are severed, burrs 57-1 and 57-2 (see FIG. 14) are left on outer sides 55-1 and 55-2, where they are not as likely to come into contact with a person's skin as they would be if they were left on the bottom surfaces 25-1 and 25-2 of feet 15-1 and 15-2.

The outer edges of runner bars 43-1 and 43-2 are provided with indentations 60 which, as will be seen below, assist in properly feeding clip 41 into a fastener attaching tool.

To use a fastener 11 from fastener clip 41 to couple a button to a garment, an individual fastener 11 is first detached from fastener clip 41 by severing connector posts 51-1 and 51-2. Feet 15-1 and 15-2 of the severed fastener 11 are then inserted first through a corresponding pair of button holes and then through the desired garment. Both the severing and inserting steps may be done manually or with the aid of an appropriate fastener attaching tool.

Figure 15:
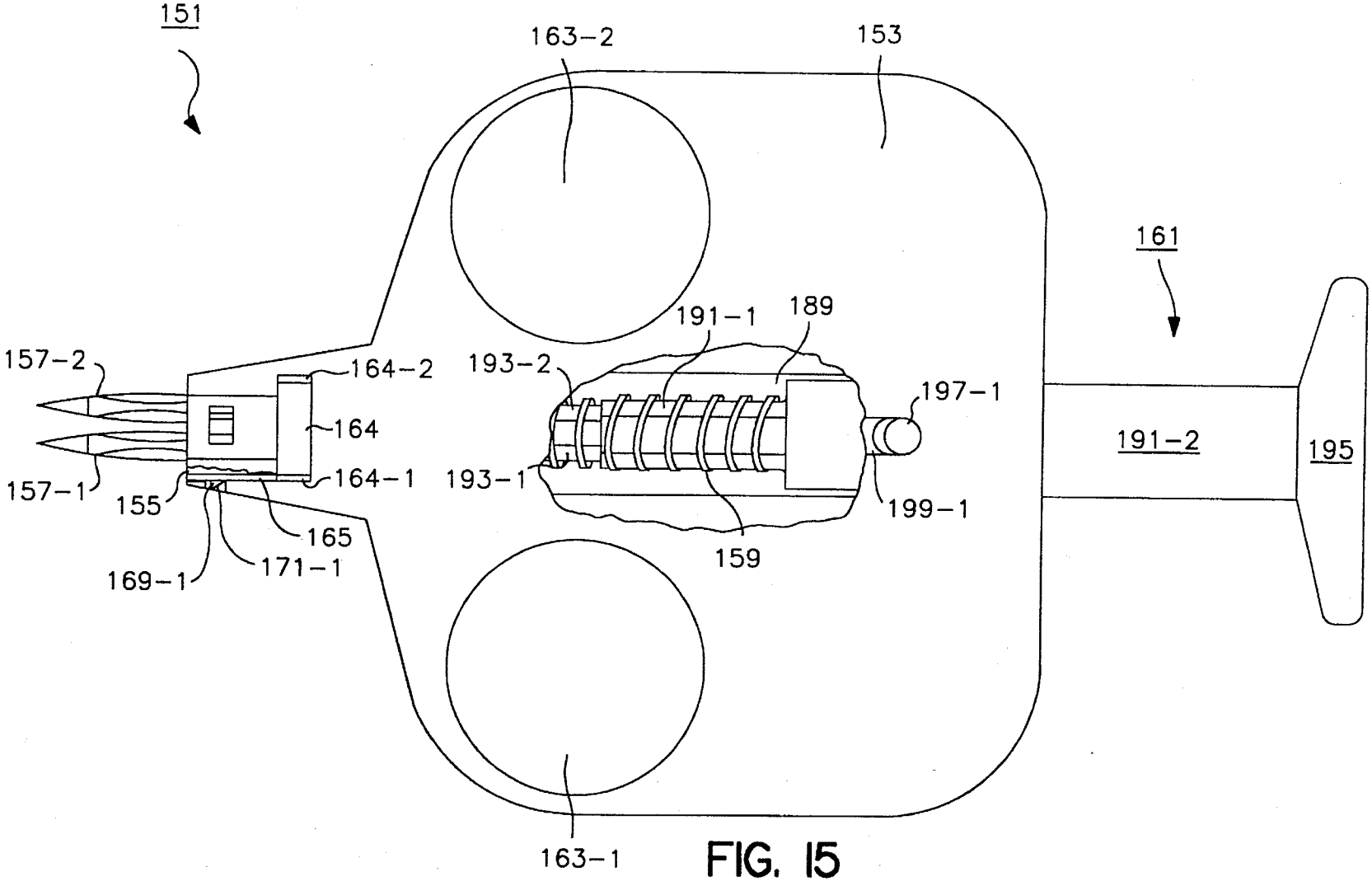
FIG. 15 is a top view of one embodiment of a fastener attaching device constructed according to the teachings of the present invention for attaching an individual fastener from the fastener clip of FIG. 6 to a garment through a pair of button holes in such a way as to attach the button to the garment.
Figure 16:
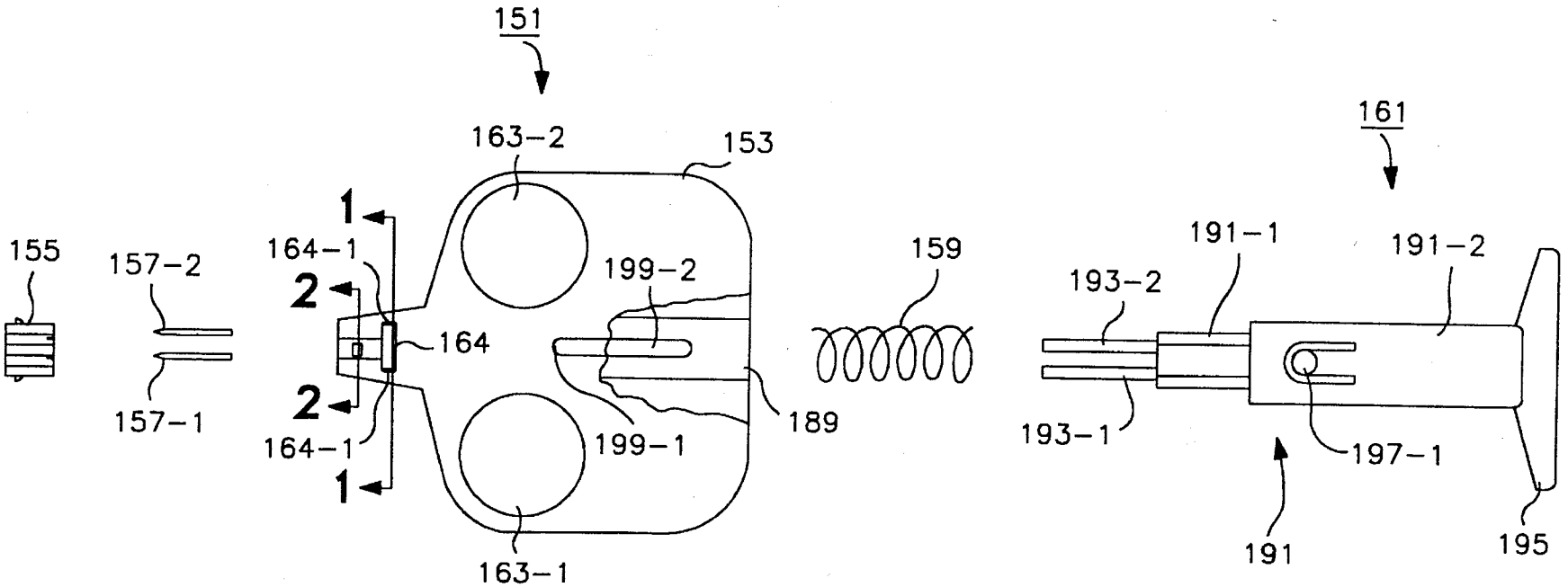
FIG. 16 is a partially exploded top view of the fastener attaching device shown in FIG. 15 with the body being broken away in part.

Referring now to FIGS. 15 and 16, there is shown one embodiment of a fastener attaching tool suitable for use with fastener clip 41 in the above-described manner, the fastener attaching tool being represented generally by reference numeral 151.

Tool 151 includes a body 153, a needle block 155, a pair of needles 157-1 and 157-2, a spring 159, and an ejector mechanism 161.

Figure 17:
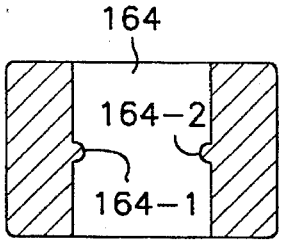
FIG. 17 is a section view of the body shown in FIG. 16 taken along line 1—1.

Body 153 is a unitary structure preferably molded from a lightweight durable plastic. Body 153 is shaped to define a pair of transverse openings 163-1 and 163-2 which are provided so that a user may operate tool 151 like a syringe by placing the index and middle fingers through openings 163-1 and 163-2 while actuating ejector mechanism 161 with the thumb. Body 153 is also provided with a transversely extending feed slot 164 down through which fastener clip 41 may be inserted in a direction perpendicular to the longitudinal axis of body 153. As can be seen best in FIG. 17, slot 164 is shaped to include a pair of feed bars 164-1 and 164-2 which, as will be discussed below in greater detail, are used to engage indentations 60 on runner bars 43-1 and 43-2, respectively, to properly align fastener clip 41 within tool 151.

Figure 19:
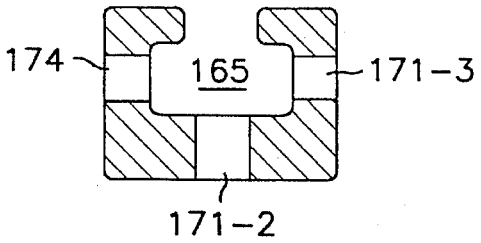
FIG. 19 is a section view of the body shown in FIG. 16 taken along line 2—2.

Needle block 155, which is removably mounted in a cavity 165 formed in body 153 and accessible from the front end thereof, is shown in greater detail in FIGS. 18(*a*) through 18(*d*). As can be seen therein, block 155 is a generally rectangular unitary structure having a pair of generally cylindrically shaped grooves 167-1 and 167-2 adapted to receive needles 157-1 and 157-2, respectively. Block 155 is retained within opening 165 by means of a plurality of outwardly biasing tabs 169-1 through 169-3 which snap into place in corresponding slots 171-1 through 171-3 (see FIG. 19) in cavity 165.

Block 155 is also preferably molded from a lightweight durable plastic.

Needle 157-1, which is a mirror image of needle 157-2 reflected along its longitudinal axis, is shown in greater detail in FIGS. 20(*a*) through 20(*d*). As can be seen therein, needle 157-1 is a unitary structure shaped to include a generally cylindrical slotted bore 173-1. Bore 173-1 has a cross-sectional diameter slightly larger than that of foot 15-1 of fastener 11. The forward end 175-1 of needle 157-1 is pointed to permit its insertion through garments and button holes of conventional size. The rearward end 177-1 of needle 157-1 is open and is appropriately dimensioned to permit foot 15-1 to be loaded into bore 173-1 with the adjacent end of filament 13 extending through the slot of bore 173-1. Needle 157-1 is retained within groove 167-1 of block 155 by means of a downwardly-angled fin 179-1 which engages a corresponding slot 181-1 in groove 167-1 (see FIGS. 18(*b*) and 18(*c*)).

The left side of needle 157-1 (viewing needle 157-1 from its rearward end 177-1 as opposed to its forward end 179-1) is shaped to define a knife 183-1. As will be described below in greater detail, knife 183-1 is used to sever the connecting post 55-1 connecting a desired fastener 11 to runner bar 43-1. (A corresponding knife edge formed on the right side of needle 157-2 is similarly used to sever the connecting post 55-2 connecting the same fastener to runner bar 43-2.)

Needles 157-1 and 157-2 are preferably cut and stamped from sheet metal.

Figure 21A:
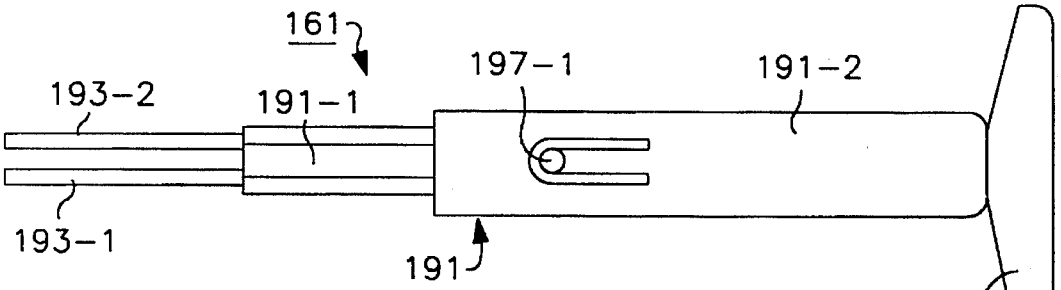
FIGS. 21(*a*) and 21(*b*) are bottom and right side views, respectively, of the ejector mechanism shown in FIG. 16.
Figure 21B:
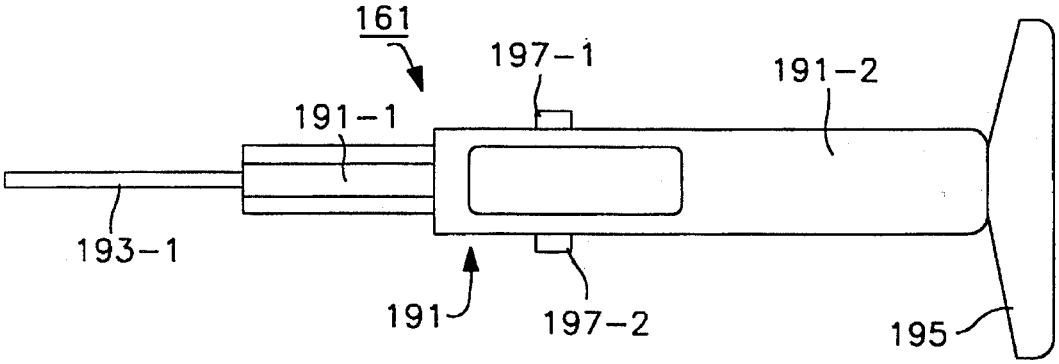
Figure 18A:
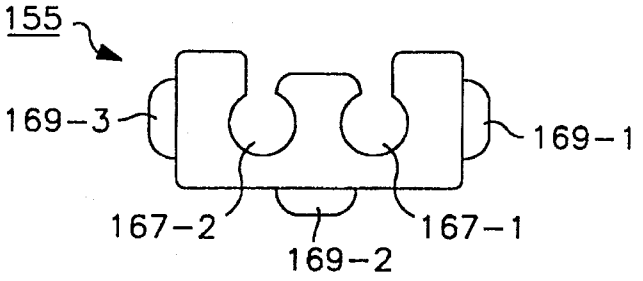
FIGS. 18(*a*) through 18(*d*) are front, rear, top and right side views, respectively, of the needle block shown in FIG. 16.
Figure 18B:
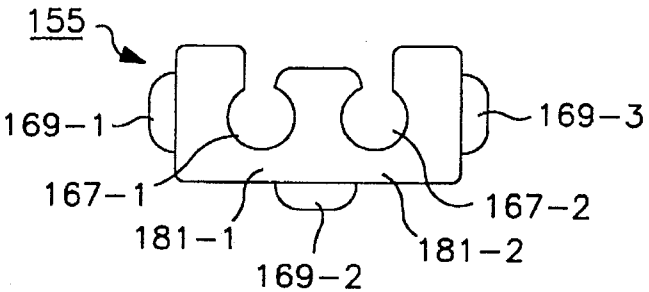
Figure 18C:
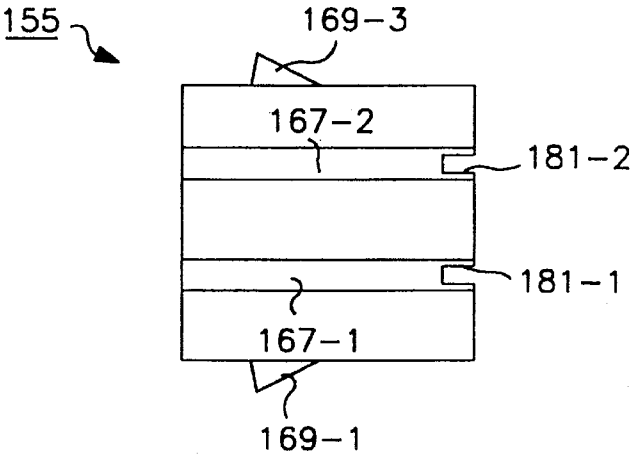
Figure 18D:
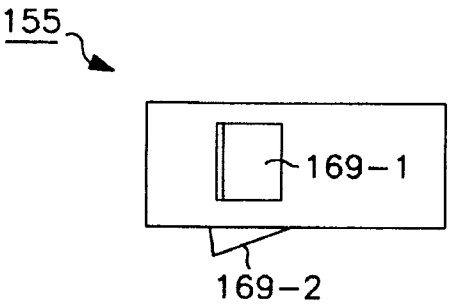
Figure 20A:
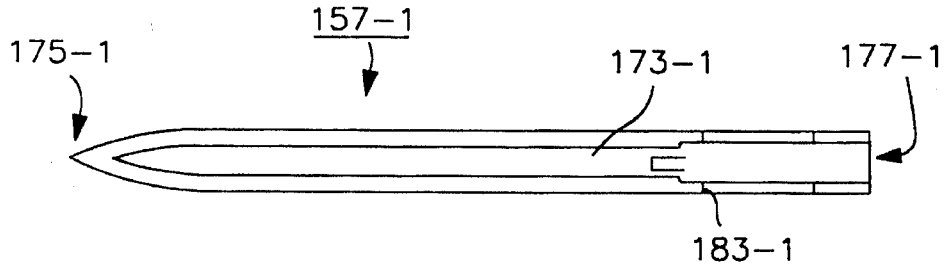
FIGS. 20(*a*) through 20(*d*) are top, right side, left side and rear views, respectively, of one of the needles shown in FIG. 16.
Figure 20B:
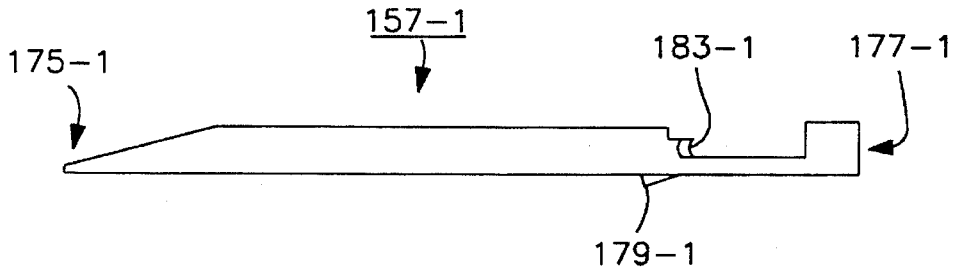
Figure 20C:
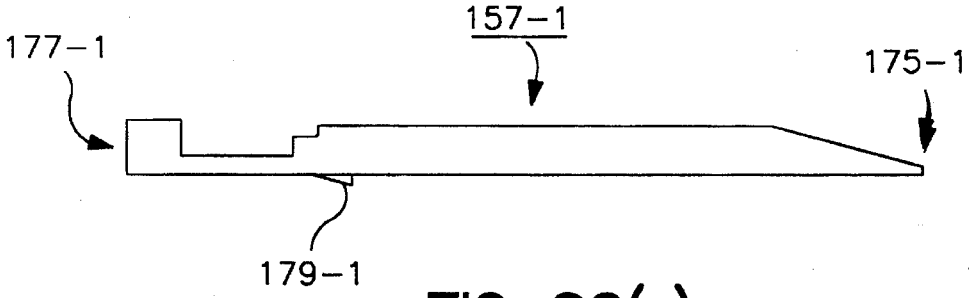
Figure 20D:
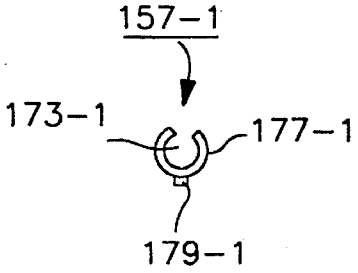

Ejector mechanism 161, which is shown in greater detail in FIGS. 21(*a*) and 21(*b*), is slidably mounted within a longitudinally extending channel 189 formed in body 153 and accessible from the rear end thereof. As can be seen therein, mechanism 161 comprises an elongated generally rectangular ejector block 191 having a front portion 191-1 of comparatively smaller cross-section and a rear portion 191-2 of comparatively larger cross-section. A pair of ejector rods 193-1 and 193-2 are fixedly mounted on the forward end of front portion 191-1. As will hereinafter be described in greater detail, ejector rods 193-1 and 193-2 are appropriately dimensioned and properly positioned so that, as ejector block 191 moves through channel 189, the front ends of ejector rods 193-1 and 193-2 cause feet 15-1 and 15-2 of a fastener 11 which is properly disposed within slot 164 to be loaded onto needles 157-1 and 157-2 and thereafter to be ejected therefrom. A disc-shaped base 195 is fixedly mounted on the rearward end of rear portion 191-2 to facilitate manipulation of mechanism 161.

Ejector rods 193-1 and 193-2 are preferably made of metal, and the remainder of ejector mechanism 161 is preferably molded from lightweight durable plastic.

Longitudinal movement of mechanism 161 within channel 189 is restricted by base 195 and by a pair of integrally formed posts 197-1 and 197-2 disposed on the top and bottom surfaces, respectively, of rear portion 191-2 which travel in corresponding guide slots 199-1 and 199-2 (see FIG. 16) formed in body 153. Posts 197-1 and 197-2 are made to be depressable inwardly to permit insertion of block 191 into channel 189. Spring 159, which engages the front of channel 189 at one end and the forward end of rear portion 191-2 at the opposite end, biases ejector mechanism 161 towards the rear of channel 189.

Figure 22:
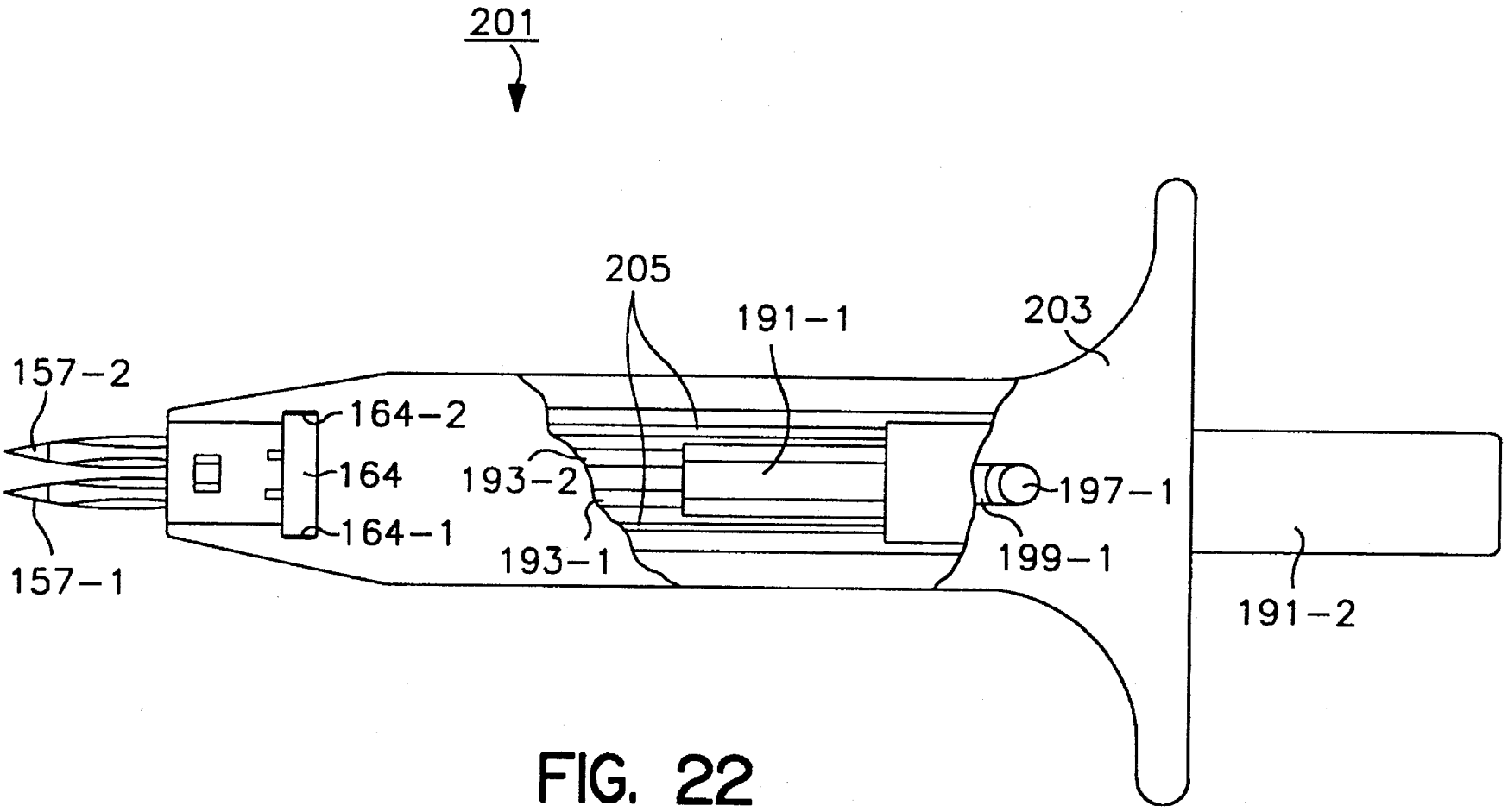
FIG. 22 is a top view, broken away in part, of a second embodiment of a fastener attaching device constructed according to the teachings of the present invention for attaching an individual fastener from the fastener clip of FIG. 6 to a garment through a pair of button holes in such a way as to attach the button to the garment.
Figure 23A:
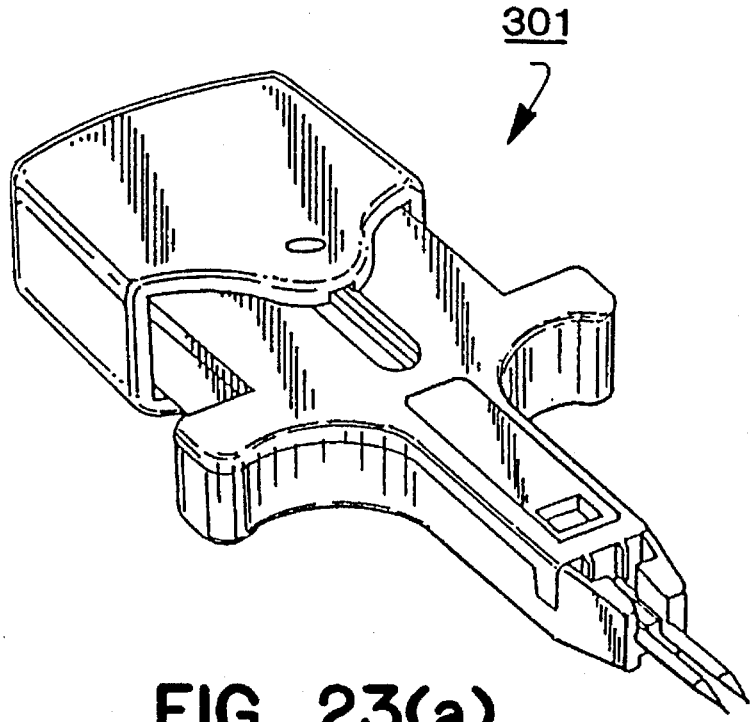
FIGS. 23(*a*) through 23(*g*) are top perspective, top, bottom, right side, left side, front and rear views, respectively, of a third embodiment of a fastener attaching device constructed according to the teachings of the present invention for attaching an individual fastener from the fastener clip of FIG. 6 to a garment through a pair of button holes in such a way as to attach the button to the garment.
Figure 23B:
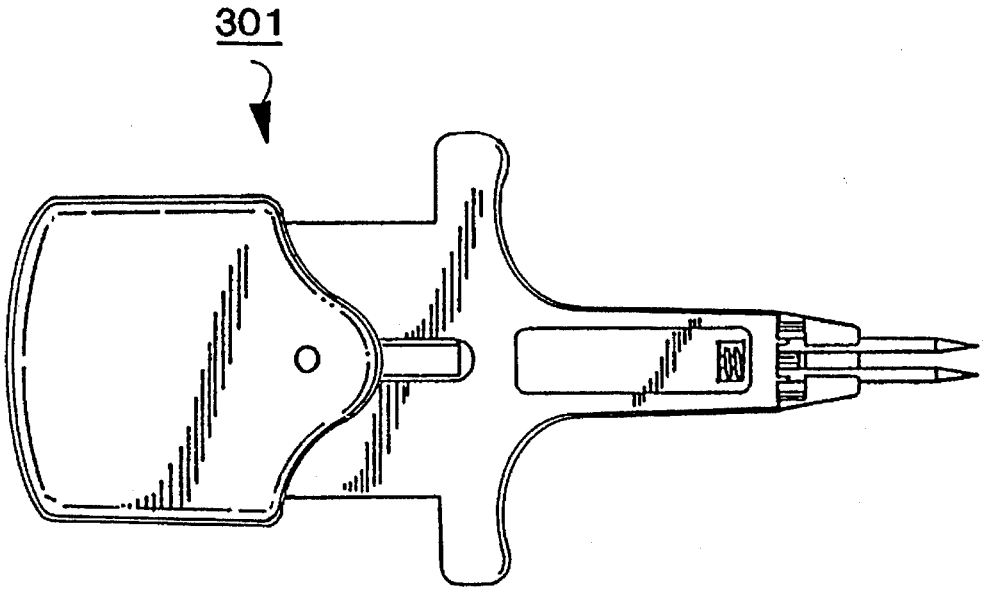
Figure 23C:
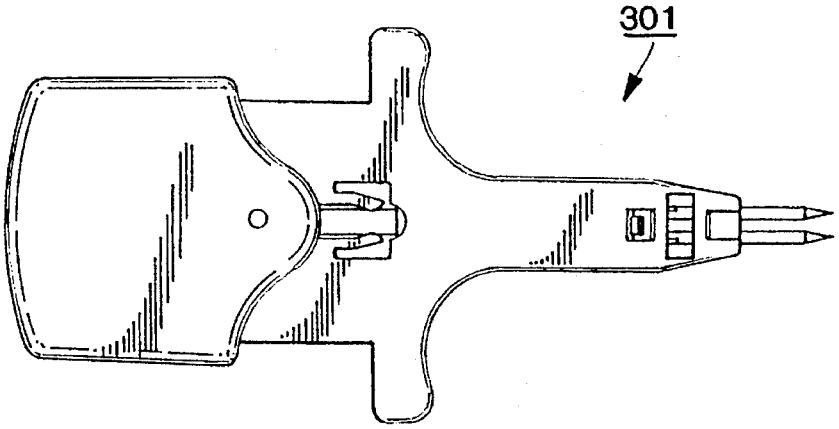
Figure 23D:
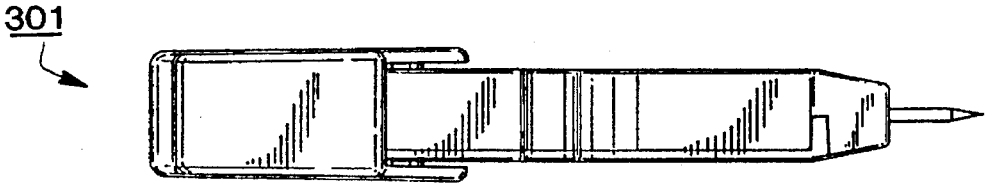
Figure 23E:
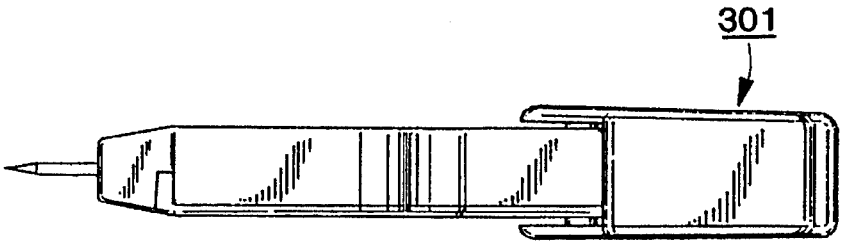
Figure 23F:
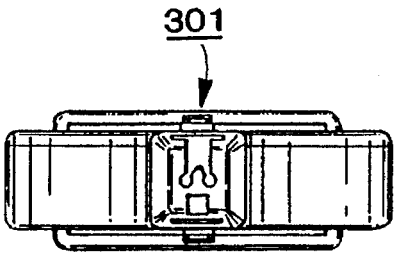
Figure 23G:
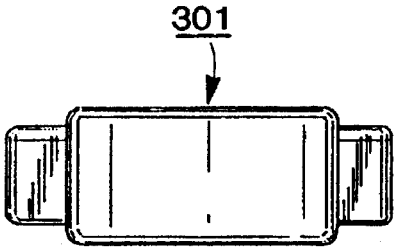
Figure 24B:
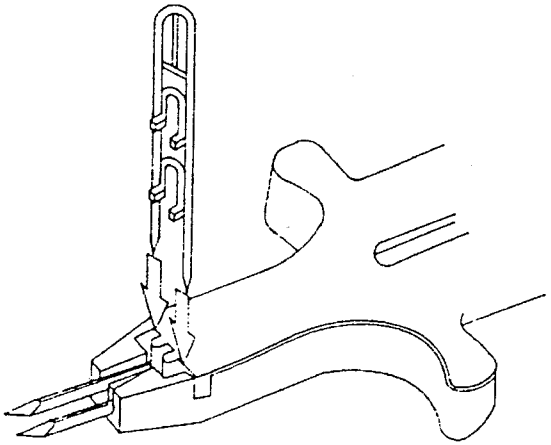
FIGS. 24(*a*) through 24(*d*) are perspective views, illustrating the manner in which the fastener clip of FIG. 6 is loaded into the fastener attaching tool of FIG. 23.
Figure 24D:
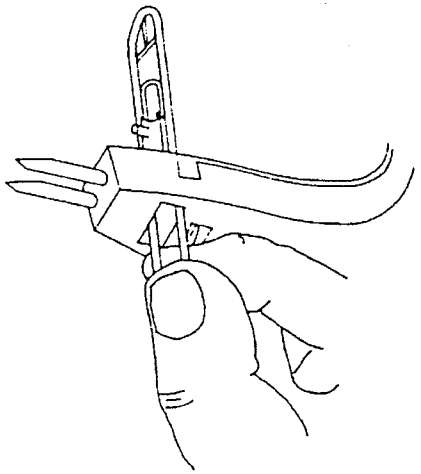
Figure 24A:
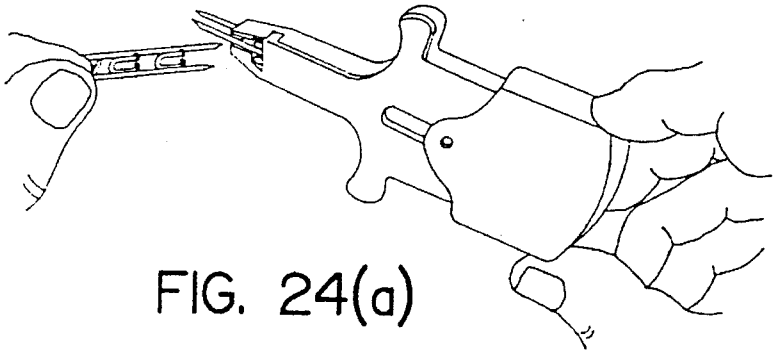
Figure 24C:
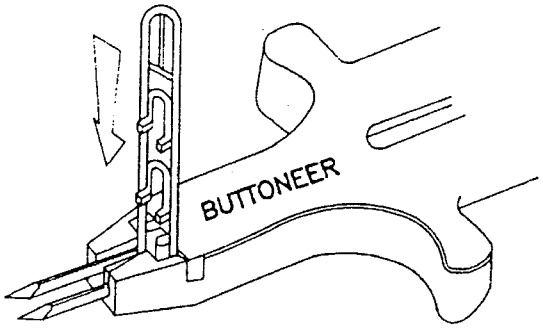

A fastener dispensing tool similar in construction to tool 151 is shown in FIG. 22, the tool being represented generally by reference numeral 201. The differences between tool 201 and tool 151 are few, the principal differences being the shape of body 203, the lack of a base 195 in tool 201, and the construction of spring 205. Tool 201 is operated in the same way as tool 151.

A fastener dispensing tool similar in construction to tool 201 is shown in FIGS. 23(*a*) through 23(*g*), the tool being represented generally by reference numeral 301. The differences between tool 201 and 301 are few, tool 301 being essentially the same as tool 121 described in U.S. patent application Ser. No. 08/185,679, filed Jan. 24, 1994.

The manner in which a fastener clip 41 is loaded into any of tools 151,201 and 301 is shown in FIGS. 24(*a*) through 24(*d*). As can be seen, this is done by grasping handle 45, inserting runner bar 43-1 into the slot in the tool and then pulling the clip 41 down through the slot until the indentations 60 on runner bars 43-1 and 43-2 corresponding to a desired fastener 11 are engaged by the bars within the tool. When this is done, feet 15-1 and 15-2 of the desired fastener 11 are positioned behind the needles, and are in alignment with their corresponding bores.

To attach a button to a piece of fabric using a fastener loaded in tool 151, the tips of the needles 157-1 and 157-2 are inserted first through a pair of holes in the button and then through the piece of fabric. Ejector mechanism 161 is then advanced through channel 189 towards the front of body 153. The initial advancement of ejector mechanism 161 causes ejector rods 193-1 and 193-2 to push feet 15-1 and 15-2 of the desired fastener 11 into bores 173-1 and 173-2. As the advancement of ejector mechanism 161 continues, ejector rods 193-2 and 193-2 push feet 15-1 and 15-2 past knife edges 183-1 and 183-2 of needles 157-1 and 157-2, causing connector posts 51-1 and 51-2 to be severed thereby. Finally, as the advancement of ejector mechanism 161 terminates, ejector rods 193-1 and 193-2 cause feet 15-1 and 15-2 to be ejected from the front ends of needles 157-1 and 157-2. Ejector mechanism 161 is then allowed to retract and needles 157-1 and 157-2 are withdrawn.

Figure 25:
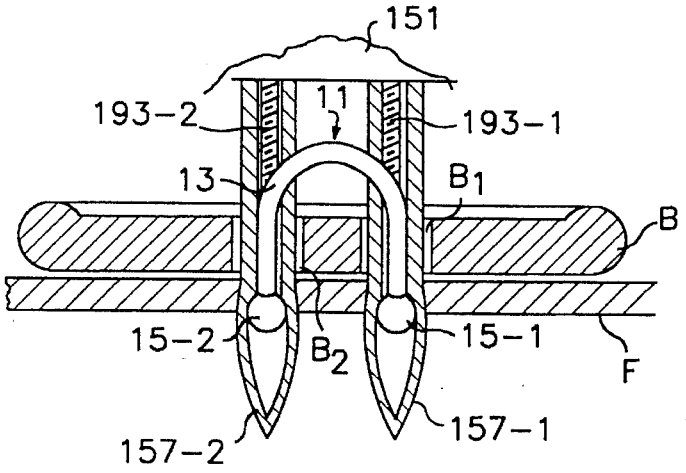
FIG. 25 is an enlarged section view of the front end of the fastener attaching device of FIG. 22 shown with the pair of ejector rods in an advanced position to illustrate how one of the fasteners shown in FIG. 1 may be inserted through a pair of button holes and secured to a garment.

FIG. 25 shows a fastener 11 being inserted through a pair of button holes $B_1$ and $B_2$ and into a piece of fabric F using tool 151.

Figure 26:
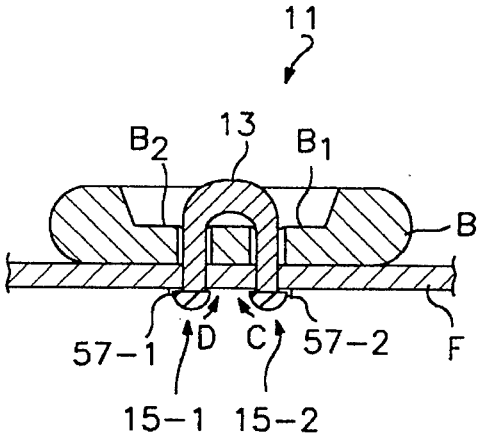
FIG. 26 is an enlarged section view similar to FIG. 25 but after the fastener attaching device has been removed showing how one of the fasteners shown in FIG. 1 is used to attach a button to a garment.
Figure 27:
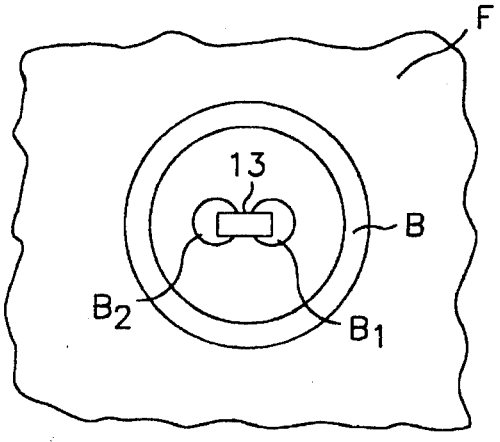
FIG. 27 is a top view of the combination of the button, garment and fastener shown in FIG. 26.

Referring now to FIGS. 26 and 27, there are shown section and top views, respectively, of a button B which has been coupled to a piece of fabric F using fastener 11. As seen best in FIG. 26, the advantages resulting from gating fastener 11 to runner bars 43-1 and 43-2 on the outer sides of feet 15-1 and 15-2 are substantial as burrs 57-1 and 57-2 are not left on the bottoms of feet 15-1 and 15-2 where they are most likely to irritate a person's skin. The consequences of making the top surfaces of feet 15-1 and 15-2 flat, as opposed to curved, to give feet 15-1 and 15-2 a low profile as well as to keep feet 15-1 and 15-2 from rocking in the directions indicated by arrows C and D can also be seen in FIG. 26. As seen best in FIG. 27, another benefit to fastener 11 is that, by having filament 13 extend between button holes $B_1$ and $B_2$ in a looped fashion, it creates the appearance that thread, as opposed to a plastic fastener, is being used to secure the button to the fabric.

Figure 29:
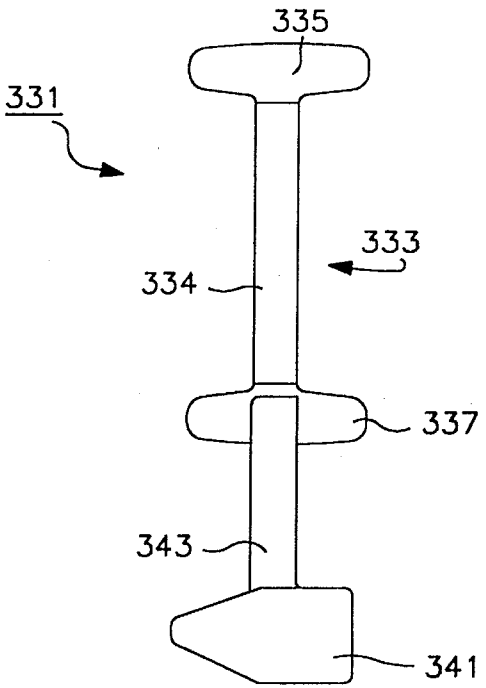
FIG. 29 is a left side view of the fastener clip shown in FIG. 28.
Figure 28:
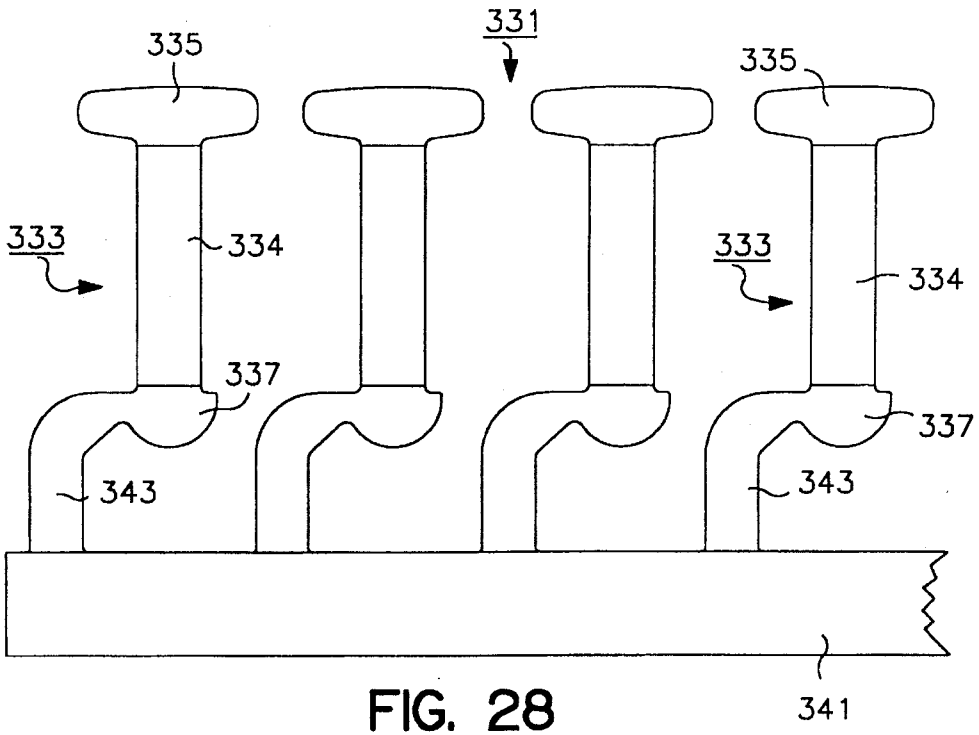
FIG. 28 is a fragmentary front view of a second embodiment of a fastener clip constructed according to the teachings of the present invention.
Figure 30:
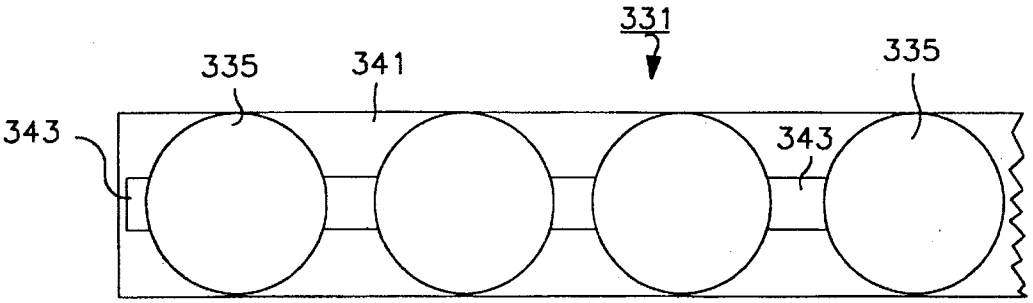
FIG. 30 is a top view of the fastener clip shown in FIG. 29.

Referring now to FIGS. 28 through 30, there are shown various views of a second embodiment of a fastener clip constructed according to the teachings of the present invention, the fastener clip being represented generally by reference numeral 331.

Fastener clip 331 includes a plurality of identical fasteners 333, each fastener 333 including a flexible filament 334 having a head 335 at one end and a foot 337 at the opposite end. Foot 337 is similar in size and shape to feet 15-1 and 15-2 of fastener 11. Fastener clip 331 also includes a runner bar 341 which is severably connected to fasteners 333 by connector posts 343, each connector post 343 being connected to the side of its corresponding foot 337.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A fastener for attaching a button to a piece of fabric, the button having two or more holes, said fastener comprising a flexible filament, a first transverse bar at one end of said flexible filament, and a second transverse bar at the opposite end of said flexible filament, said flexible filament having a substantially uniform width over its length, a non-uniform thickness and a bent shape prior to use in connection with attaching the button to the piece of fabric, said first and second transverse bars being parallel to one another and perpendicular to said flexible filament, said flexible filament and said pair of transverse bars being appropriately dimensioned so that said pair of transverse bars may be inserted through a corresponding pair of holes in the button and then through the piece of fabric in such a way as to be retained by the underside of the piece of fabric, with said flexible filament extending between the pair of holes.

2. The fastener as claimed in claim 1 wherein said flexible filament is bent at the midpoint between said transverse bars and wherein said flexible filament is thinner near said transverse bars and thicker at said midpoint.

3. A fastener for attaching a button to a piece of fabric, the button having two or more holes said fastener comprising a flexible filament, a first transverse bar at one end of said flexible filament, and a second transverse bar at the opposite end of said flexible filament, said first and second transverse bars being parallel to one another and perpendicular to said flexible filament, each of said first and second transverse bars having a front end, a rear end and a bottom surface, said bottom surface having a midpoint between said front end and said rear end, said bottom surface dipping downwardly at its midpoint and sloping upwardly on opposite sides of said midpoint towards said front and rear ends, each of said first and second transverse bars having a cross-sectional diameter that is greatest at its midpoint and that diminishes on opposite sides thereof towards said front and rear ends, said flexible filament and said pair of transverse bars being appropriately dimensioned so that said pair of transverse bars may be inserted through a corresponding pair of holes in the button and then through the piece of fabric in such a way as to be retained by the underside of the piece of fabric, with said flexible filament extending between the pair of holes.

4. The fastener as claimed in claim 3 wherein said flexible filament is U-shaped prior to use in connection with attaching said button to said piece of fabric.

5. The fastener as claimed in claim 4 wherein each of said first and second transverse bars has a fiat top surface.

6. The fastener as claimed in claim 5 wherein each of said first and second transverse bars has rounded ends.

7. A fastener clip adapted to be fed into a fastener attaching tool, said fastener clip comprising:

a) a first fastener comprising a U-shaped flexible filament, a first transverse bar at one end of said flexible filament and a second transverse bar at the opposite end of said flexible filament;

b) a first runner bar;

c) a second runner bar, said second runner bar extending generally parallel to said first runner bar and extending downwardly further than said first runner bar; and c) a severable connector for connecting said first runner bar to said first fastener; and d) a severable connector for connecting said second runner bar to said first fastener.

8. The fastener clip as claimed in claim 7 further comprising a second fastener, said second fastener being identical to said first fastener, a severable connector for connecting said first runner bar to said second fastener, and a severable connector for connecting said second runner bar to said second fastener.

9. The fastener clip as claimed in claim 7 wherein said fastener clip is made by injection molding using molds shaped to prevent the formation of a knit-line in said fastener.

10. The fastener clip as claimed in claim 9 wherein said first and said second runner bars form a handle and wherein said knit-line is formed in said handle.

* * * * *